United States Patent [19]

McCormick et al.

[11] 4,083,619

[45] Apr. 11, 1978

[54] ELECTRICAL CONNECTOR

[75] Inventors: David Michael McCormick, Redondo Beach; Earl Andrew Cooper, Mar Vista, both of Calif.

[73] Assignee: Automation Industries, Inc., Los Angeles, Calif.

[21] Appl. No.: 807,896

[22] Filed: Jun. 20, 1977

[51] Int. Cl.[2] ..... H01R 13/54

[52] U.S. Cl. ..... 339/75 M; 339/91 R

[58] Field of Search ..... 339/75 M, 91 R

[56] References Cited

U.S. PATENT DOCUMENTS

| | | | |
|---|---|---|---|
| 3,501,735 | 3/1970 | Bauman et al. | 339/75 M |
| 3,575,482 | 4/1971 | McMaster et al. | 339/75 M X |
| 3,594,694 | 7/1971 | Clark | 339/75 M X |
| 3,629,791 | 12/1971 | Normann | 339/75 M X |
| 3,953,098 | 4/1976 | Avery et al. | 339/91 R X |

*Primary Examiner*—Roy Lake
*Assistant Examiner*—E. F. Desmond
*Attorney, Agent, or Firm*—Thomas L. Flattery

[57] ABSTRACT

An electrical connector for establishing a positive interconnection between a first set of electrical contacts and a second set of electrical contacts which employs the use of a receptacle section and a plug section. The receptacle section includes a collet receiving opening therein. The plug section includes a plurality of collet fingers which are to be locatable within the collet receiving opening and establishing a positive interlocking therewith. The collet fingers are integrally formed within a sleeve which has a drawbolt slideably mounted therein. The drawbolt is movable by a manual actuation means between an extended position and a retracted position. With the drawbolt in the extended position the collet fingers are capable of being deflected thereby permitting movement of the receptacle section with respect to the plug section. The head portion of the drawbolt being located directly adjacent to the collet fingers, the deflection of the collet fingers is not permitted thereby not permitting disassociation of the receptacle section from the plug section.

8 Claims, 6 Drawing Figures

ELECTRICAL CONNECTOR

BACKGROUND OF THE INVENTION

At the present time there is a large variety of different types of electrical connectors for joining the individual wires in a first cable with the individual wires in a second cable. Most of these electrical connectors are satisfactory for the applications they have been designed. However, many of them have limitations which reduce their usefulness and prevent or severely restrict their use on other applications.

A common problem which is frequently encountered is the mating of the two sections of the connector. The mating operation has frequently required a considerable amount of manual manipulation, such as screwing the parts together. Such manual manipulation is time consuming and difficult, particularly when the connector is located in an inaccessible location. This is especially true in aircraft installation in which space is of a prime consideration. In such installations, electrical cable is frequently installed within structural channels. Different sections of cable are to be electrically connected within these channels. The operation of a screwthreaded type of electrical connector is extremely hampered within such a channel. Also, the space located directly above the channel is frequently very limited. Therefore, there is a strong need for an electrical connector which can be easily and efficiently operated from a point distant from the connector and when such is operated it is immediately known whether or not a positive electrical interlock has been achieved.

SUMMARY OF THE INVENTION

The electrical connector of this invention is designed in particular to be placed within close quartered situations. The electrical connector comprises a receptacle section and a plug section with the plug section including a plurality of electrical contacts which are to mate with a plurality of electrical contacts in the receptacle section. The receptacle section includes an enlarged opening which is adapted to receive therein an extended cylindrical protion of the plug which takes the form of a sleeve. Within the sleeve are formed a plurality of radially deflectable fingers. Each of the fingers includes an enlarged protuberance on the tip of the finger with the protuberance to be locatable within an annular groove formed within the wall of the opening in the receptacle. A drawbolt is movable within the sleeve and with the tip of the drawbolt located in alignment with the fingers, deflection of the fingers is not permitted. Upon the drawbolt being moved forwardly, the portion of the drawbolt after the head is relieved and with the fingers connecting with this relieved section, radial deflection of the fingers is possible. Movement of the drawbolt is accomplished through the use of a pin and slot arrangement formed within a cam assembly. The cam assembly is attached to a pivot rod. The pivot rod is pivotable by means of a handle. The handle is slideably movable a limited distance in respect to the pivot rod.

DETAILED DESCRIPTION OF THE SHOWN EMBODIMENT

Figure 1:
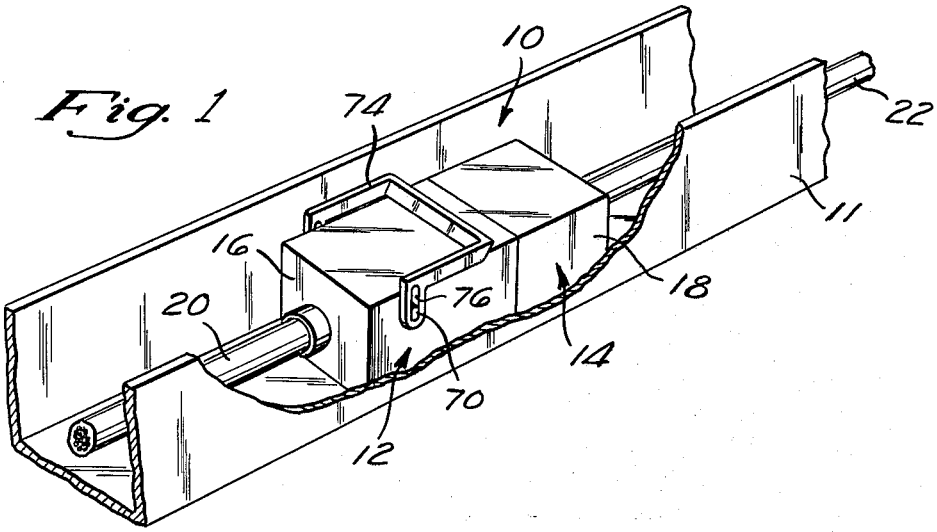
FIG. 1 is a perspective view of the electrical connector of this invention showing such installed within a structural channel.

Referring particularly to the drawings, there is shown in FIG. 1 a depicted installation area for the electrical connector 10 of this invention which may comprise a structural channel 11 located within an aircraft or some other type of apparatus. The electrical connector 10 has a plug section 12 and a receptacle section 14. The plug section 12 is encased within a housing 16 and the receptacle section 14 is encased within a housing 18. An electrical cable 20, which is composed of a plurality of separate electrical conducting wires (not shown) extends within the housing 16 of the plug section 12. A second electrical cable 22 extends within the housing 18 of the receptacle section 14. The structural channel 11 is provided to support and guide the electrical cables 20 and 22 to transmit electrical energy from one locale to another. The purpose of the electrical connector 10 is to electrically interconnect the cables 20 and 22.

The receptable section 14 includes an interface 24 within which are formed a plurality of openings 26. The outmost surface of each opening 26 is slightly cone-shaped for a purpose which will become more readily apparent further on in the specification.

Also formed within the interface 24 is an enlarged opening 28. The enlarged opening 28 is basically cylindrical with its wall surface therein including an annular groove 30. Annular groove 30 is spaced a short distance from the interface 24.

Each of the openings 26 connect with a chamber 32 formed within the housing 18. It is to be understood that there is a separate chamber 32 for each and every opening 26. Within each chamber 32 is located a female electrical socket contact 32. Each electrical socket contact 34 is connected to a separate electrical wire located within a cable 22.

Each electrical socket contact 34 is capable of being electrically connected with a male electrical pin contact 36. The electrical pin contacts 36 are mounted within interface 38 of the housing 16. Each electrical pin contact 36 is to be electrically connected to a separate wire (not shown) which is located within the cable 20.

Also protruding from the face 38 is a sleeve 40. The sleeve 40 is slideably mounted within cylindrical shaped opening 42 formed within the housing 16. Slideably mounted within the sleeve 40 is a drawbolt 44. The major portion of the drawbolt 44 is of a diameter smaller than the diameter of the head 46.

The sleeve 40 has integrally formed therein a plurality of collet fingers 48. Each of the collet fingers 48 are basically elongated U-shaped members which are attached to the sleeve 40 only at the back end of each finger. The front end of each finger 48 includes an enlarged protuberance 50. It is to be noted that there are four in number of The fingers 48 and also four in number of the protuberances 50 with the fingers 48 being evenly spaced apart about the sleeve 40.

It is to be noted that the fingers 48 are deflectable inwardly if the relieved portion of the drawbolt 44 is located directly beneath the fingers 50. However, if the enlarged head 46 of the drawbolt 44 is located directly under the protuberances 50, that only a slight inwardly deflecting movement of the fingers 48 is permitted and further inwardly deflecting movement is not permitted. The sleeve 40 has a key 49 thereon which keys into a keyway 51 provided in the enlarged opening 28 before the receptacle 14 and plug 12 are locked together as hereinafter discussed.

The rear portion of sleeve 40 has a collar 53 therearound. A coil spring 52 is placed around the sleeve 40 and bears against the collar 53 exerting a continuous bias tending to cause the sleeve 40 to be extended as much as possible away from the opening 42.

Integrally attached to the drawbolt 44 adjacent to the backend thereof is a rod 54. The rod 54 extends through a slot 56 in the sleeve 40. Attached to the upper end of the rod 54 is a pin 58. The pin 58 cooperates within a pair of arcuate slots 60 and 62. Each of the arcuate slots 60 and 62 are located respectively within cam plates 64 and 66. Cam plates 64 and 66 are fixedly secured to pivot rod 68. The pivot rod 68 is pivotly mounted within the housing 16.

The outer ends of the pivot rod 68 are formed into non-circular sections 70 and 72. A bail handle 74, which is basically U-shaped in configuration, has elongated slots 76 and 78 formed within the end of each of the legs of the U-shaped bail handle 74. The end 70 rides within the slot 76 and the end 72 rides within the slot 78.

Figure 2:
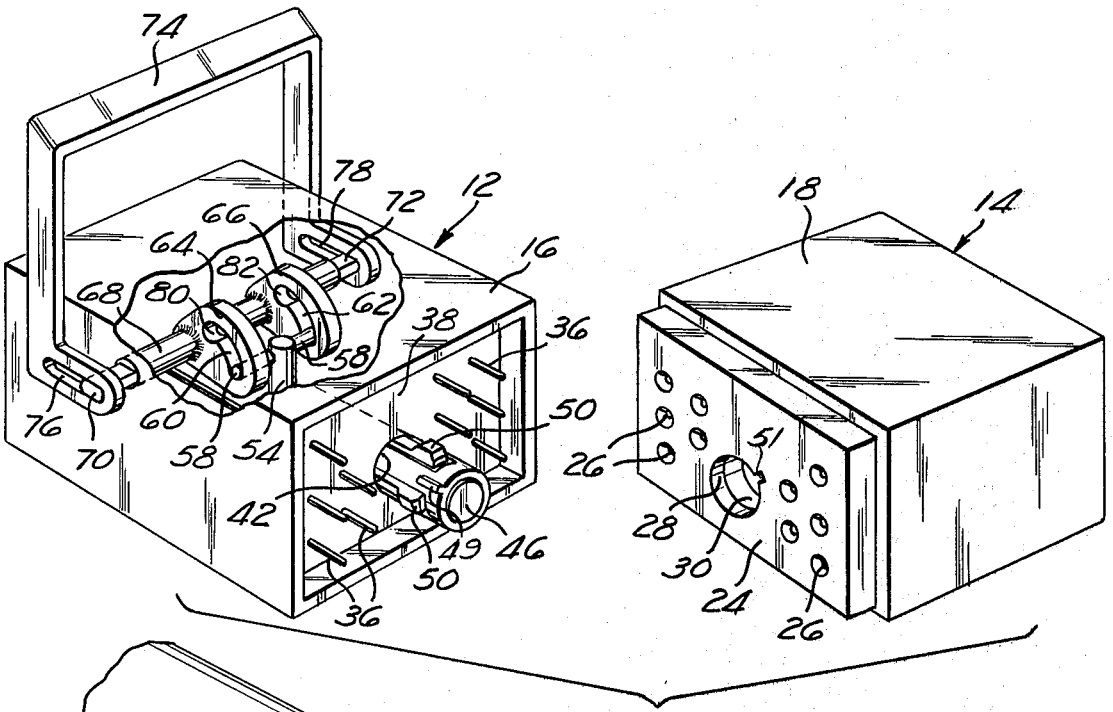
FIG. 2 is an exploded perspective view of the electrical connector of this invention showing both the plug section and the receptacle section.
Figure 3:
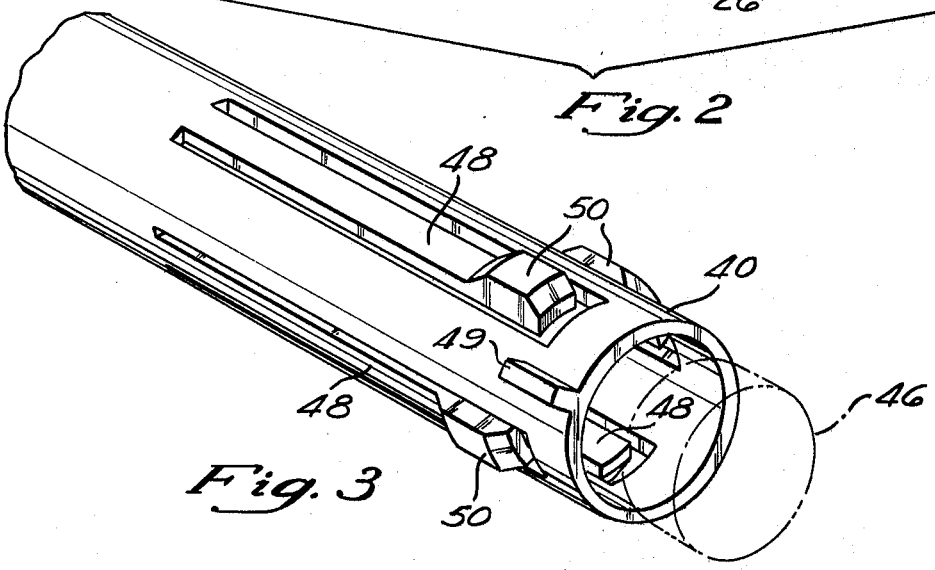
FIG. 3 is a perspective view of the deflectable fingers formed within the sleeve which is incorporated within the plug section of the electrical connector of this invention.
Figure 4:
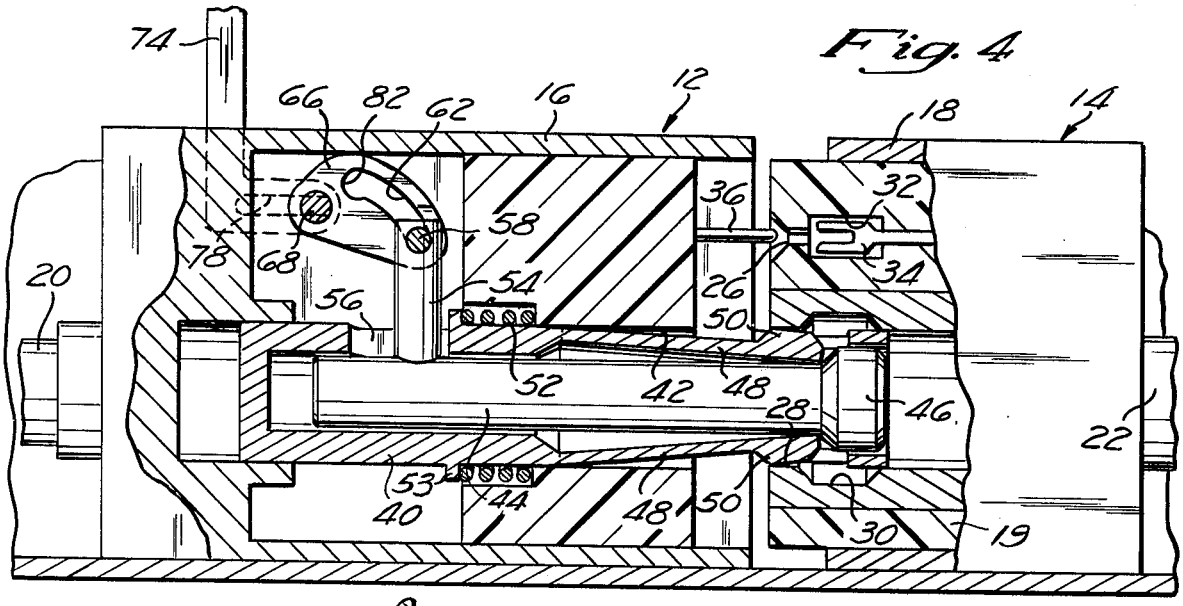
FIG. 4 is a longitudinal cross-sectional view through the interior of the electrical connector of this invention showing the electrical connector in the position of initiating interconnection between the plug section and the receptacle section.
Figure 5:
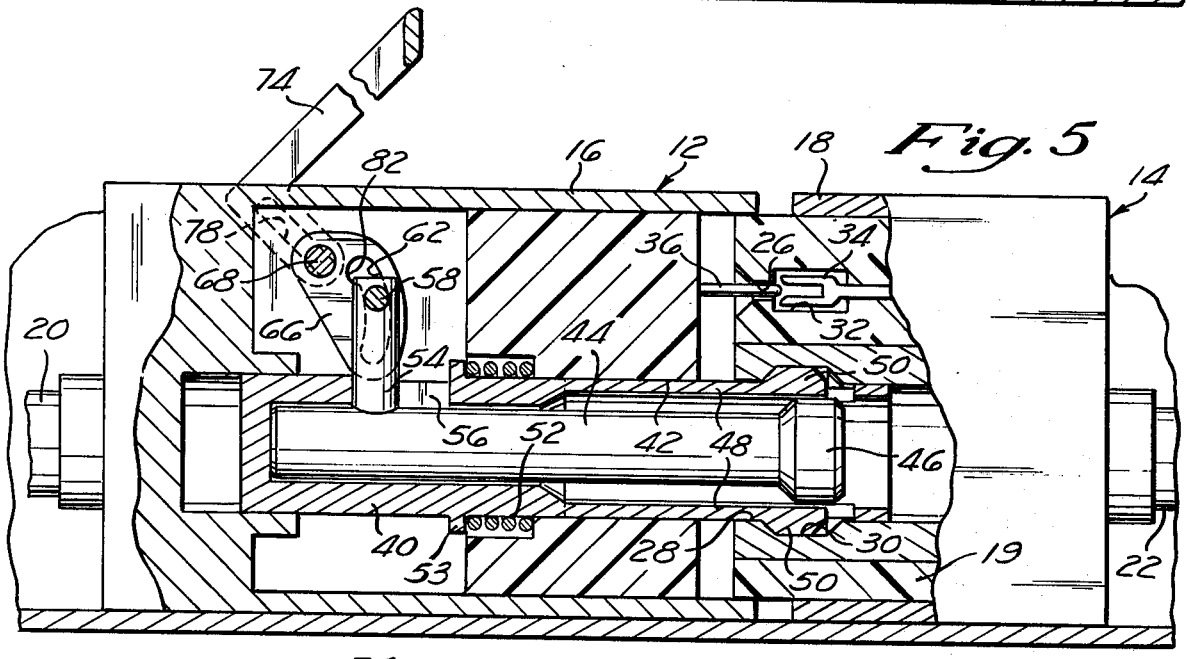
FIG. 5 is a view similar to FIG. 4 but with the interconnection between the receptacle section and the plug section being located in an intermediate position.

The operation of the device of this invention is as follows: It will be assumed that the device is in a disassembled condition with the plug section 12 being spaced from the receptacle section 14. The operator places the plug section 12 adjacent the receptacle section 14 within the structural channel 11. The bail handle 74 is in the position shown in FIG. 2 of the drawings which is substantially at a right angle to the upper surface of the housing 16. The operator then moves the plug section 12 so that the sleeve 40 enters the opening 28. As the sleeve 40 enters the opening 28, the heads 50 of the collet fingers 48 deflect inwardly as shown in FIG. 4 of the drawings, since the enlarged head 46 of the drawbolt 44 is displaced forward of the collet fingers 48. Movement of the plug section 12 with respect to the receptacle section 14 is continued until the protuberances 50 of the collet fingers 48 are located within annular groove 30 as shown in FIG. 5 of the drawings. At this particular time, the bail handle 74 is pivoted which causes the pin 58 to move within the slots 60 and 62. This causes the drawbolt 44 to be moved rearwardly until the head 46 is located directly under the protuberances 50. This position is shown within FIG. 5 of the drawings and inward deflecting movement of the fingers 48 is prevented. Therefore, the receptacle section 14 is connected to the plug section 12. However, it is to be noted that in this position the electrical plug pin contacts 36 to not yet cooperate with the female electrical socket contacts 34

Figure 6:
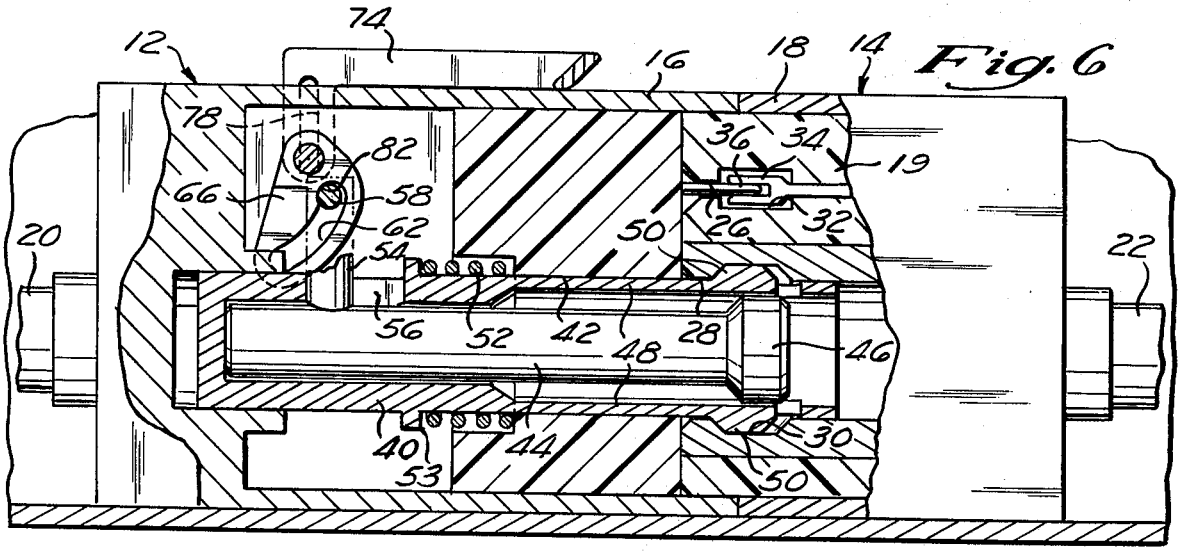
FIG. 6 is a view similar to FIG. 4 but showing the electrical connector in the completely interlocked position.

As the handle 74 is continued to pivot about the pivot rod 68, the drawbolt 44 continues to move rearwardly. However, it is to be noted that the rod 54 is located at the back end of the slot 56, so therefore, the sleeve 40 moves in synchronism with the drawbolt 44 against the bias of the spring 52. It is this amount of movement that achieves the electrical interconnection between the electrical connectors 34 and 36. With the bail handle 74 then located against the upper surface of the housing 16, this position being shown in FIG. 6 of the drawings, the desired electrical connection between the sections 12 and 14 has been achieved and also there is a slight locking action tending to maintain this position by the pin 58 falling within detents 80 and 82 formed within the respective slots 60 and 62.

It is to be noted that in accomplishing the total engaging movement of the device 10 that the pin 58 is drawn significantly nearer the axis of the pivot rod 68. This changes the fulcrum point for the force acting on the handle 74 which provides a mechanical advantage for approximately six to one available to fully engage the electrical contacts.

In addition to the handle 74 being able to rotate about the axis of the pivot rod 68, the handle 74 is also capable of sliding movement with respect to the pivot rod 68. The limits of this sliding movement is determined by the lengths of the slots 76 and 78. This type of movement is desirable so as to permit operation of the device in quarters that may be significantly cramped and which include other paraphernalia.

What is claimed is:

1. An electrical connector comprising:

a receptacle section having a first set of electrical contacts, said receptacle section having a collet opening therein, first connecting means connecting with said collet opening;

a plug section having a second set of electrical contacts, said plug section capable of mating with said receptacle section producing electrical interconnection between said first and said second sets of electrical contacts, said plug section including second connecting means movable between an extended position and a retracted position;

means being movable between a first position and a second position, with said means in said first position said second connection means is maintained in said extended position; and manual actuation means connected to said means to move said means between said first and said second positions.

2. The electrical connector as defined in claim 1 wherein:

said second connecting means including a sleeve, said sleeve including a plurality of spaced apart collet fingers, each said collet finger including an outwardly extending protuberance; and said first connecting means including an annular groove formed within the wall surface of said collet opening, with said second connecting means in said extended position said protuberances of said collet fingers cooperating within said annular groove.

3. The electrical connector as defined in claim 2 wherein:

said second connecting means including a drawbolt slideably mounted within said sleeve, the forward-most end of said drawbolt having an enlarged annular head with the portion of said drawbolt adjacent said head being relieved forming a smaller diametered section, with said enlarged head located inwardly of said protuberances on said collet fingers, inward movement of said collet fingers is thereby prevented, with said relieved section being located inwardly of said protuberances of said collet fingers, a limited amount of inward movement of said collet fingers is permitted.

4. The electrical connector as defined in claim 3 wherein:

spring means exerting a continuous bias against said sleeve tending to maintain said sleeve in said first position.

5. The electrical connector as defined in claim 4 wherein:

said manual actuation means being pivotable about a pivot axis, said manual actuation means including a handle, with said means in said first position said handle being located substantially parallel to the longitudinal axis of said sleeve, with said means in said second position the said handle being inclined with respect with respect to the longitudinal axis of said sleeve.

6. The electrical connector as defined in claim 5 wherein:

said handle being slidingly movable with respect to said pivot axis.

7. The electrical connector as defined in claim 5 wherein:

said pivot axis being achieved through a pivot pin, a cam plate fixed to said pivot pin, said cam plated including an arcuate slot, a pin riding within said slot, said pin being connected to said drawbolt.

8. The electrical connector as defined in claim 7 wherein:

a detent connecting with said arcuate slot, with said drawbolt in said first position said pin located within sald slot connecting with said detent.

* * * * *